US010098435B2

(12) United States Patent
Choi et al.

(10) Patent No.: US 10,098,435 B2
(45) Date of Patent: Oct. 16, 2018

(54) COSMETIC PRODUCT COMPRISING RUBBER DISCHARGE PAD

(71) Applicant: AMOREPACIFIC CORPORATION, Seoul (KR)

(72) Inventors: Jung Sun Choi, Yongin-si (KR); Hye Ran Ji, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 0 days.

(21) Appl. No.: 15/125,073

(22) PCT Filed: Mar. 17, 2015

(86) PCT No.: PCT/KR2015/002577
§ 371 (c)(1),
(2) Date: Sep. 9, 2016

(87) PCT Pub. No.: WO2015/142033
PCT Pub. Date: Sep. 24, 2015

(65) Prior Publication Data

US 2017/0013939 A1 Jan. 19, 2017

(30) Foreign Application Priority Data

Mar. 17, 2014 (KR) ..... 10-2014-0030903
Mar. 17, 2015 (KR) ..... 10-2015-0036768

(51) Int. Cl.
*A45D 40/00* (2006.01)
*A45D 34/00* (2006.01)
(Continued)

(52) U.S. Cl.
CPC ..... *A45D 40/0075* (2013.01); *A45D 33/006* (2013.01); *A45D 33/025* (2013.01); *A45D 34/00* (2013.01)

(58) Field of Classification Search
None
See application file for complete search history.

(56) References Cited

U.S. PATENT DOCUMENTS 188,233 A * 3/1877 Oahoone ..... B68B 3/00
54/41.1
2,137,790 A * 11/1938 Thompson ..... A45D 33/34
401/200
(Continued)

FOREIGN PATENT DOCUMENTS

JP 9-22117 A 8/1997
JP 2013180549 A * 9/2013 ..... B29C 45/26
(Continued)

OTHER PUBLICATIONS

JP 2013-180549 EPO translation (Year: 2013).*
(Continued)

*Primary Examiner* — Ernst V Arnold
*Assistant Examiner* — Kyung S Chang
(74) *Attorney, Agent, or Firm* — Merchant & Gould P.C.

(57) ABSTRACT

The present invention provides a cosmetic product comprising a rubber discharge pad, which comprises radially distributed discharge holes and is made from a rubber material, and discharging the contents through the discharge holes. According to the cosmetic product of the present invention, the degree of discharge of the contents can be suitably controlled during the use of the contents, radial discharge micro-holes on the surface of the rubber discharge pad have a dispersal discharge function, the remaining amount can be minimized since even the contents of the bottom of a container can be readily used by the elasticity of the rubber discharge pad, the cosmetic product can be carried without leakage of the contents since the contents are covered with the rubber discharge pad, and always having the feeling of
(Continued)

using a new product is enabled since contact between the external air and contaminants is blocked during the use thereof.

11 Claims, 5 Drawing Sheets

(51) Int. Cl.
*A45D 33/02* (2006.01)
*A45D 33/00* (2006.01)

(56) References Cited

U.S. PATENT DOCUMENTS

| | | | | |
|---|---|---|---|---|
| 2,519,401 | A * | 8/1950 | Rockwell | A41D 27/26 2/268 |
| 3,021,649 | A * | 2/1962 | Robbins | B24D 15/04 15/118 |
| 5,865,194 | A | 2/1999 | Gueret | |
| 6,883,995 | B1 * | 4/2005 | Gueret | A45D 34/04 401/183 |
| 2011/0299911 | A1 * | 12/2011 | Sasaki | A45D 33/02 401/143 |
| 2015/0079862 | A1 | 3/2015 | Jeong et al. | |
| 2015/0118269 | A1 * | 4/2015 | Choi | A45D 37/00 424/401 |

FOREIGN PATENT DOCUMENTS

| | | | | |
|---|---|---|---|---|
| KR | 20-0239113 | Y1 | 7/2001 | |
| KR | 20-0437581 | Y1 | 12/2007 | |
| KR | 10-1157218 | B1 | 6/2012 | |
| KR | 10-2013-0116194 | A | 10/2013 | |
| WO | WO-2013154391 | A1 * | 10/2013 | A45D 37/00 |

OTHER PUBLICATIONS

International Search Report and English Translation for International Patent Application No. PCT/KR2015/002577, dated May 29, 2015.

Written Opinion for International Patent Application No. PCT/KR2015/002577, dated May 29, 2015.

* cited by examiner

【FIG. 1】
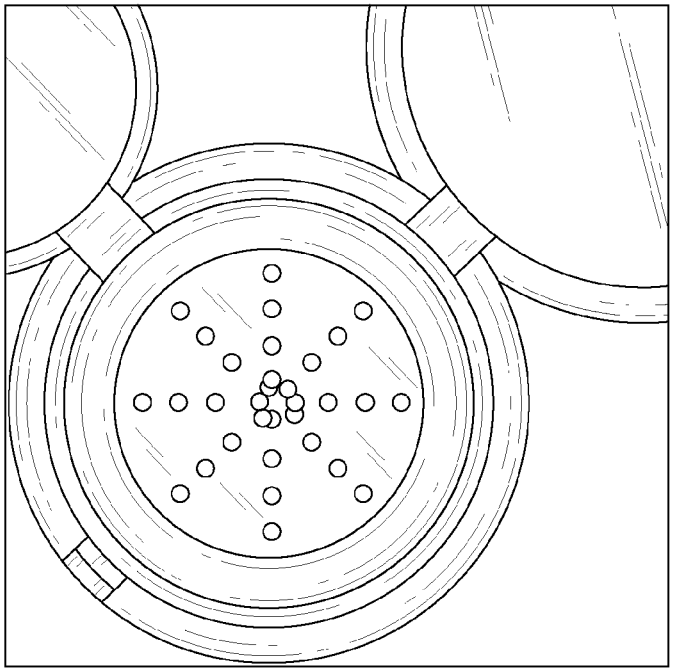
【FIG. 2】
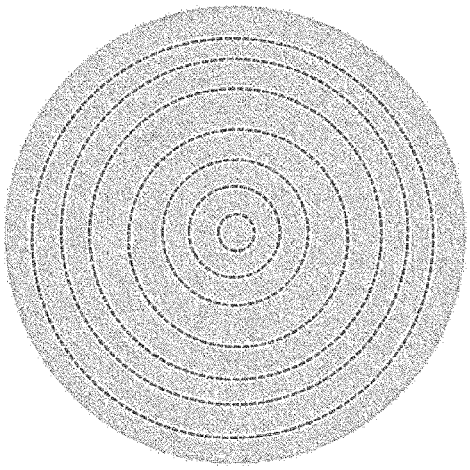

【FIG. 3】
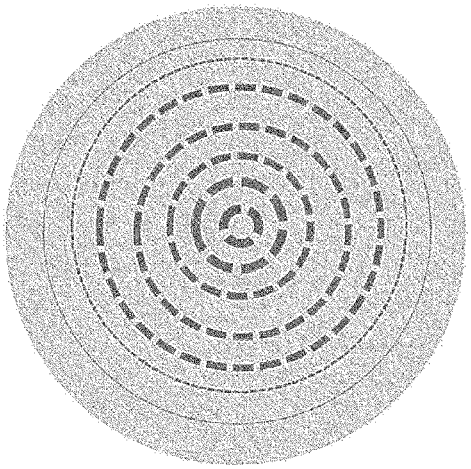
【FIG. 4】
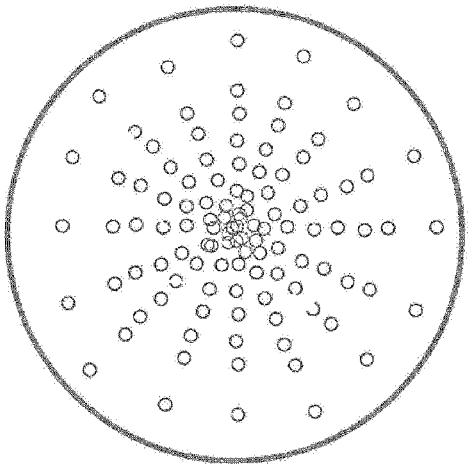

【FIG. 5】
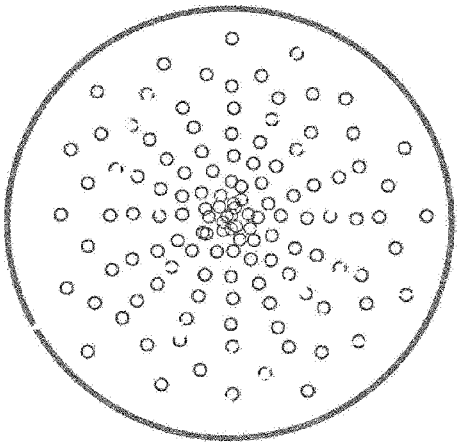
【FIG. 6】
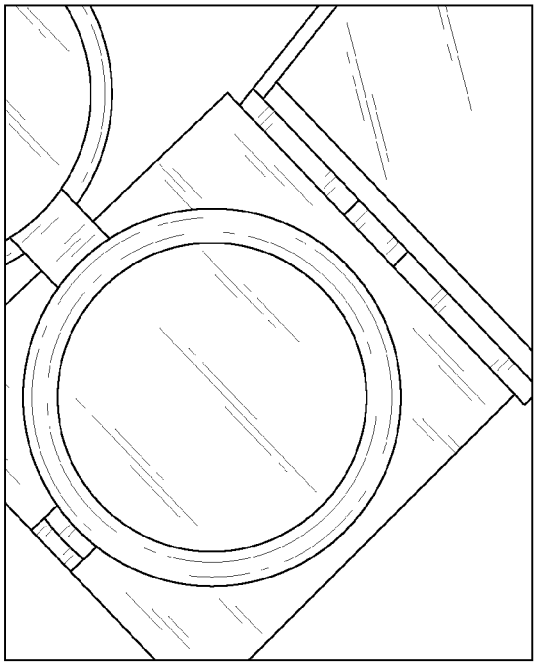

【FIG. 7】
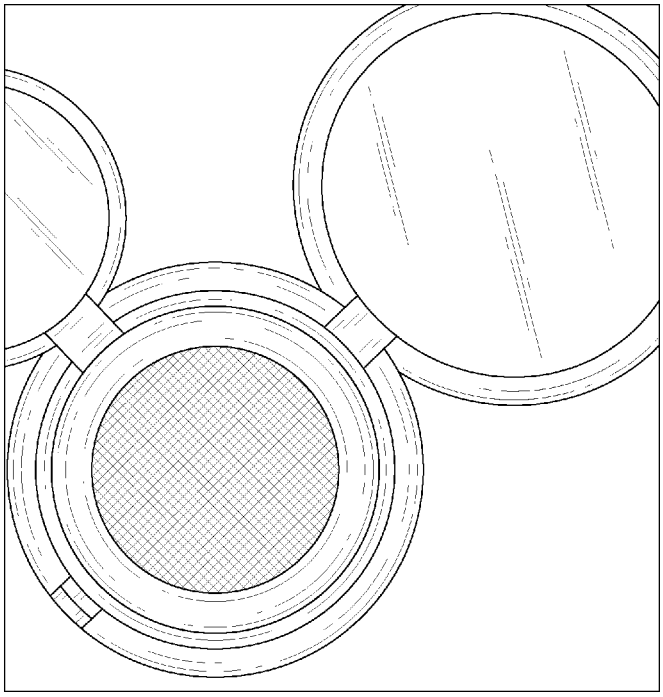
【FIG. 8】
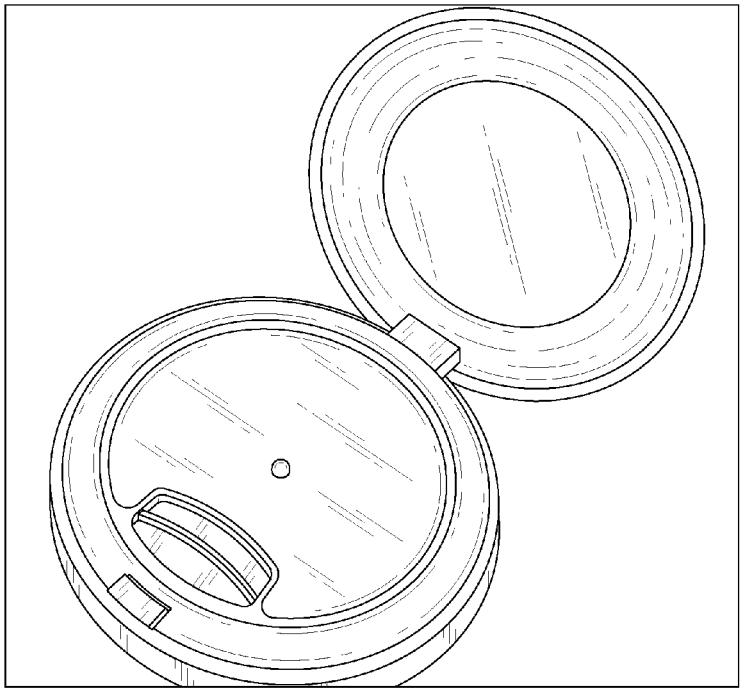

【FIG. 9】
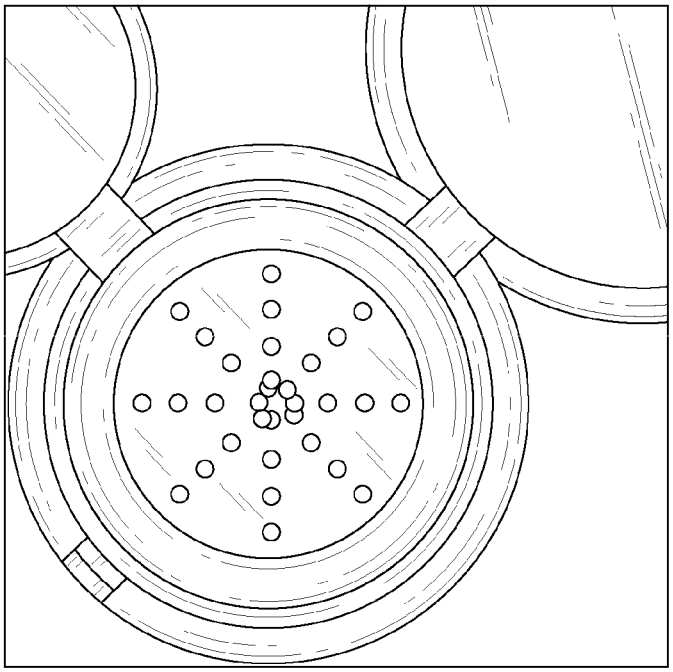

COSMETIC PRODUCT COMPRISING RUBBER DISCHARGE PAD

This application is a National Stage Application of International Patent Application No. PCT/KR2015/002577 filed 17 Mar. 2015, which claims the benefit of priority to Korean Patent Application No. 10-2015-0036768 filed 17 Mar. 2015 and to Korean Patent Application No. 10-2014-0030903 filed 17 Mar. 2014, the disclosures of all of which are hereby incorporated by reference in their entireties. To the extent appropriate, a claim of priority is made to each of the above-disclosed applications.

TECHNICAL FIELD

The present disclosure relates to a cosmetic product including a rubber discharge pad. More particularly, the present disclosure relates to a cosmetic product including a rubber discharge pad which has discharge holes and is capable of controlling the discharge amount of contents.

BACKGROUND

In the case of the conventional pact products, most of them are pressed pact formulations obtained by compressing powdery contents or oil-dispersed formulations of powder or cake, or emulsified pact formulations. In the case of loose powder or cake formulations using powdery contents as they are, not as pressed formulations, they have an intermediate structure with a net structure (screen net) that allows controlled use of contents. Most of such net structures have a mesh size of at least 3-5 mm. Since such net structures are for use in smearing puff with a predetermined amount of contents, they should have a size of at least 3-5 mm.

In addition, conventional pact products include liquid pact products which discharge liquid contents in a predetermined amount. Conventional products of this type have an airless structure having a single discharge hole and discharge contents as bulk in a discharge amount of 0.1-0.4 g. Moreover, such liquid pact products having an airless pact structure characteristically have a limitation in packing amount and leave a large amount of residue, resulting in short service life. The above-mentioned problems of bulky discharge and short service life cause dissatisfaction of consumers in terms of a cosmetic effect and convenience of use.

Under these circumstances, there is suggested a cosmetic product containing contents having a rubber discharge pad structure in order to increase a cosmetic effect through dispersal discharge and to allow use of contents to the end.

DISCLOSURE

Technical Problem

A technical problem to be solved by the present disclosure is to provide a cosmetic product including a rubber discharge pad, which controls a degree of discharge of contents adequately by the rubber discharge pad having discharge holes, and allows use of contents even in the case of contents present in the bottom of a container to minimize a residual amount.

Technical Solution

In one general aspect, there is provided a cosmetic product which includes a rubber discharge pad made of a rubber material having radially distributed discharge holes, and discharges contents through the discharge holes.

According to an embodiment, the rubber may be at least one selected from the group consisting of acrylonitrile-butadiene rubber (NBR), fluorinated NBR, hydrogenated NBR, silicone rubber, NBR-silicone composite rubber, styrene butadiene rubber (SBR), polychloroprene rubber (CR), isoprene-isobutylene rubber (IIR), butadiene rubber (BR), isoprene rubber (IR), ethylene propylene rubber (EPR), ethylene propylene diene monomer (EPDM) rubber, thermoplastic elastomer, polysulfide rubber, fluororubber, urethane rubber, polyester, polyether, chlorosulfonated polyethylene rubber, acryl and olefins.

According to another embodiment, the rubber may be at least one selected from the group consisting of acrylonitrile-butadiene rubber (NBR), fluorinated NBR, hydrogenated NBR, silicone rubber and NBR-silicone composite rubber.

According to still another embodiment, the discharge holes may have a size of 0.005-2.5 mm.

According to still another embodiment, the discharge holes may be present in a number of 1-50 per unit area of 1 $cm^2$.

According to still another embodiment, the discharge holes may be formed by laser perforation.

According to still another embodiment, the rubber discharge pad may have a circular or polygonal shape.

According to still another embodiment, the rubber discharge pad may have an elongation of 1%-500%, when force is applied to a unit area of 1 $cm^2$ of the rubber discharge pad in the longitudinal direction.

According to still another embodiment, the rubber discharge pad may have a Shore A hardness of 10A or more and a Shore D hardness of 75D or less.

According to still another embodiment, the rubber discharge pad may have a thickness of 0.05-2 mm.

According to still another embodiment, the rubber discharge pad may have a tensile strength of 20 $kg/cm^2$ or more.

According to still another embodiment, the rubber discharge pad may further include a rim surrounding the same.

According to yet another embodiment, the contents may have a viscosity of 3,000-100,000 cps.

Advantageous Effects

The cosmetic product according to the embodiments of the present disclosure controls a degree of discharge of contents adequately when using the contents, shows a dispersive discharge function through the fine discharge holes formed radially on the surface of the rubber discharge pad, allows use of contents even in the case of contents present in the bottom of a container by virtue of the elasticity of the rubber discharge pad to minimize a residual amount, has good portability without leakage of contents by virtue of the rubber discharge pad covering the contents, and always provides a feel of use like that of a new product because the contact with the external air and contaminants is prevented upon use.

DESCRIPTION OF DRAWINGS

FIG. 1 is a schematic view illustrating the pact container including a rubber discharge pad as a cosmetic product according to an embodiment of the present disclosure.

FIG. 2-FIG. 5 are schematic views each illustrating the rubber discharge pad of the cosmetic product according to an embodiment of the present disclosure.

FIG. 6 is a photograph image of Conventional pact Cake type (Comp. Ex. 1) of Table 1.

FIG. 7 is a photograph image of Pact including screen net (Comp. Ex. 2) of Table 1.

FIG. 8 is a photograph image of Airless pact (Comp. Ex. 3) of Table 1.

FIG. 9 is a photograph image of Pact including rubber discharge pad (Ex. 1) of Table 1.

BEST MODE

The exemplary embodiments will be described hereinafter for a person with ordinary skills in the art to easily perform the present invention.

In one aspect, there is provided a cosmetic product which includes a rubber discharge pad made of a rubber material having radially distributed discharge holes, and discharges contents through the discharge holes.

As used herein, the term 'cosmetic product' may refer to only a container for receiving contents (also referred to as 'cosmetic composition' or 'cosmetic agent') itself, or may refer to a container for receiving contents in combination with contents received therein.

According to an embodiment, the rubber is not particularly limited as long as it is elastic rubber showing rubber elasticity at room temperature (20-30° C.). The rubber may be at least one selected from the group consisting of acrylonitrile-butadiene rubber (NBR), fluorinated NBR, hydrogenated NBR, silicone rubber, NBR-silicone composite rubber, styrene butadiene rubber (SBR), polychloroprene rubber (CR), isoprene-isobutylene rubber (IIR), butadiene rubber (BR), isoprene rubber (IR), ethylene propylene rubber (EPR), ethylene propylene diene monomer (EPDM) rubber, thermoplastic elastomer, polysulfide rubber, fluororubber, urethane rubber, polyester, polyether, chlorosulfonated polyethylene rubber, acryl and olefins.

Preferably, the rubber may be at least one selected from the group consisting of acrylonitrile-butadiene rubber (NBR), fluorinated NBR, hydrogenated NBR, silicone rubber and NBR-silicone composite rubber.

The silicone rubber has excellent elasticity and weather resistance, and particularly shows a small variation in strength and elongation at high temperature.

The fluorinated NBR is rubber having heat resistance and chemical resistance, and the NBR-silicone composite rubber is composite rubber of NBR having high oil resistance with silicone having high weather resistance.

The hydrogenated NBR (also referred to as "H-NBR") is produced through hydrogenation of NBR, which has been used generally as rubber having high oil resistance, shows improved heat resistance while maintaining the properties of NBR, and has improved weather resistance, ozone resistance and wear resistance. Dry polyurethane rubber and wet polyurethane rubber have high elasticity and shows wear resistance, aging resistance and oil resistance.

The styrene-butadiene rubber (SBR) has excellent aging resistance, heat resistance and wear resistance.

The polychloroprene rubber (CR) has high weather resistance, ozone resistance, heat aging resistance and oil resistance, and excellent chemical resistance and flame resistance.

The isoprene-isobutylene rubber (IIR) shows low rebound elasticity but has very high impact absorption and excellent chemical resistance, weather resistance, heat resistance and ozone resistance.

The butadiene rubber (BR) has high elasticity and low internal heat emission, and thus shows excellent cold resistance and aging resistance.

The ethylene propylene diene monomer (EPDM) rubber has excellent weather resistance, ozone resistance, heat resistance and low-temperature characteristics, and shows high water vapor resistance, chemical resistance and durability against temperature and humidity.

Particular examples of the thermoplastic elastomer may include polypropylene/ethylene propylene diene monomer (PP/EPDM), polyamide, or the like.

The polysulfide rubber has excellent oil resistance, aging resistance and ozone resistance.

The urethane rubber may include wet polyurethane or dry polyurethane.

The polyester may include aliphatic polyester rubber, including biodegradable resins, such as polylactic acid (PLA), poly-β-hydroxybutyrate (PHB) or polycaprolactone (PCL), and aromatic polyester rubber, including polyethylene terephthalate (PET), polybutylene terephthalate (PBT) or polyethylene naphthalate (PEN).

The chlorosulfonated polyethylene rubber has excellent weather resistance, ozone resistance and chemical resistance.

The acryl rubber (AR) has excellent heat resistance, oil resistance, weather resistance and ozone resistance.

Although there is no limitation in the discharge holes formed in the rubber discharge pad, the discharge holes may be formed by laser perforation. Fine holes are formed by laser perforation.

In addition, the discharge holes formed in the rubber discharge pad are preferably distributed radially from the center of the rubber discharge pad toward the edge thereof.

According to still another embodiment, the discharge holes may have a size of 0.005-2.5 mm, preferably 0.01-2.5 mm, and more preferably 0.5-1.0 mm. Herein, the size of discharge holes means the diameter or length of the discharge holes. When the discharge holes have a size smaller than 0.005 mm, the contents are discharged in an excessively small amount and smooth discharge cannot be accomplished. When the discharge holes have a size larger than 2.5 mm, the contents are discharged in an excessively large amount and a function of dispersive discharge from a cosmetic applicator (puff or brush) is degraded, resulting in an insufficient cosmetic effect. Therefore, since the contents are discharged through the discharge holes of the rubber discharge pad, it is required for the discharge holes to have a size within the above-defined range so as to provide a function of controlling an adequate amount of contents.

According to still another embodiment, the discharge holes may be present in a number of 1-50, preferably 3-50, and more preferably 5-30 per unit area of 1 $cm^2$. When the number of discharge holes per unit area of 1 $cm^2$ is less than 1, the contents are discharged in an excessively small amount. When the number of discharge holes per unit area of 1 $cm^2$ is larger than 50, the contents are discharged in an excessively large amount and bursting strength may be affected.

FIG. 2-FIG. 5 each show the rubber discharge pad having discharge holes according to the present disclosure. FIG. 2 shows an embodiment of the rubber discharge pad having non-circular and generally linearly shaped discharge holes having the same discharge hole size, and FIG. 3 shows an embodiment of the rubber discharge pad wherein the size of discharge holes increases from the outer portion of the rubber discharge pad toward the inner portion thereof. Although the discharge holes have a linear shape in drawings, the shape of discharge holes is not particularly limited to a specific shape, such as a circular shape, linear shape, or the like. In addition, FIG. 4 shows an embodiment of the rubber discharge pad wherein circular discharge holes are distributed radially, and FIG. 5 shows another embodiment of the rubber discharge pad wherein circular discharge holes are distributed radially.

According to still another embodiment, the rubber discharge pad may have a circular or a polygonal shape, such as a triangular, quadrangular or pentagonal shape, but is not limited thereto. The rubber discharge pad may have a shape varied with the shape of a container.

According to still another embodiment, the rubber discharge pad may have an elongation of 1%-500%, preferably 200-500%, when force is applied to a unit area of 1 $cm^2$ of the rubber discharge pad in the longitudinal direction. When the rubber discharge pad has an elongation less than 1%, it shows poor flexibility and convenience of use. When the rubber discharge pad has an elongation larger than 500%, it shows excessively high flexibility and thus may affect the size of the discharge holes.

According to still another embodiment, the rubber discharge pad may have a Shore A hardness of 10A or more and a Shore D hardness of 75D or less. Particularly, it is preferred that the rubber discharge pad has a Shore A hardness of 10-100A and a Shore D hardness of 10-75D.

Herein, determination of hardness is carried out with Type A Durometer (circumferential) according to the method of ASTM D2240. When the rubber discharge pad has a Shore A hardness less than 10A, it is too soft to provide sufficient elastic force. When the rubber discharge pad has a Shore D hardness larger than 75D, it is too hard to take an adequate amount of contents with an applicator. As used herein, 'hardness' means a magnitude of resistance of an object against deformation when the object is pressed with another object. The methods for determining hardness of an object include Vicker's hardness, Brinell hardness, Lockwell hardness, Shore hardness, or the like. The method of determining Shore hardness is used in the present disclosure, wherein a higher number preceding the Shore hardness mark means higher hardness. Shore types are classified into A, B, C, D, DO, O, OO, OOO and M depending on indenter. The principle of determination includes piercing an object with various types of indenters and marking a degree of rebounding as a value of hardness. Shore A uses a dull indenter and thus is applied to soft materials. Shore D uses a sharp indenter and thus is applied to hard materials.

In the cosmetic product according to the present disclosure, the compression force applied to the rubber discharge pad from an applicator (such as puff or a brush) that is a side material for applying contents is about 300 g·f-1.5 kg·f. In general, the compression force applied to the rubber discharge pad from puff is about 300-600 g·f. In the case of slightly strong compression, the force is about 1-1.5 kg·f.

According to still another embodiment, the rubber discharge pad may have a thickness of 0.05-2 mm, preferably 0.5-1 mm. When the rubber discharge pad has a thickness less than 0.05 mm, it is too thin to provide good rubber properties. When the rubber discharge pad has a thickness larger than 2 mm, it is too thick to provide a container with sufficient lockability.

According to still another embodiment, the rubber discharge pad may have a tensile strength of 20 $kg/cm^2$ or more, preferably 20-100 $kg/cm^2$, and more preferably 50-90 $kg/cm^2$. When the rubber discharge pad has a tensile strength less than 20 $kg/cm^2$, it is too weak to be used as a pad.

According to still another embodiment, the rubber discharge pad may further include a rim surrounding the same.

The cosmetic product according to the present disclosure discharges its contents through the discharge holes of the rubber discharge pad, and thus can control the discharge amount through the size of discharge holes. The cosmetic product according to the present disclosure is used by allowing an applicator to be in contact with the contents discharged through the discharge holes to take the contents, and then allowing the applicator coated with the contents to be in contact with the skin.

According to yet another embodiment, the contents may have a viscosity of 3,000-100,000 cps, preferably 8,000-25,000 cps. Such a broad range of viscosities suggests that the cosmetic product according to the present disclosure allows use of various types of contents. The viscosity of contents may be determined by using a viscometer. For example, according to an embodiment, viscosity is determined by using LVDV II+PRO or RVDV III ULTRA with spindle No. 29 and a speed of 5 rpm or 12 rpm, but is not limited thereto.

There is no particular limitation in contents received in the cosmetic product according to the present disclosure. For example, the contents may include at least one selected from the group consisting of skin lotion, skin softener, skin toner, astringent, milk lotion, moisture lotion, nourishing lotion, massage cream, nourishing cream, moisture cream, pigment-containing foundation, makeup base, eye makeup and blusher, and may also be a sunblock agent for the above-mentioned formulations.

In addition, the contents may be in the state of liquid, cream, semi-solid, solid or powder.

Further, the liquid contents may be a water-dispersed type liquid, oil-dispersed type liquid, water-in-oil (W/O) type liquid or oil-in-water (O/W) type liquid.

The rubber discharge pad used in the present disclosure has the following characteristics:

1) Chemical resistance: the rubber discharge pad causes no swelling, erosion, deformation, pigment dissolution, or the like, in response to chemicals (alcohols, oils or the like).

2) Content compatibility: the rubber discharge pad causes no swelling, deformation, pigment dissolution, solution, cosmetic agent deposition, or the like, in the presence of a cosmetic agent.

3) Wear resistance: the rubber discharge pad causes no erosion or permanent deformation by the friction with an applicator, such as a brush or puff.

4) Poison resistance: the rubber discharge pad contains no environmentally harmful material, such as a heavy metal or phthalate.

According to still another aspect, the cosmetic product according to the present disclosure may be a container including the rubber discharge pad, wherein the container may receive contents subsequently.

According to still another aspect, the cosmetic product according to the present disclosure may be a container including the rubber discharge pad, wherein the container further includes contents under the rubber discharge pad.

The cosmetic product according to the present disclosure may be in the form of a pact, jar, airless, blow, tube, bottle, or the like, but is not limited thereto.

The cosmetic product according to the present disclosure controls discharge of contents to an adequate amount through the size of the discharge hole of the rubber discharge pad, and allows use of residual contents to the highest degree by virtue of its elasticity. In addition, the rubber discharge pad is sealed against to the exterior except the discharge holes, and thus always provides a feel of using a new product during use.

The present invention now will be described more fully through the following examples. The following examples and experiments are for illustrative purposes only and not intended to limit the scope of this disclosure.

Example 1

The rubber discharge pad according to the present disclosure uses hydrogenated NBR (H-NBR), is a circular pad having a thickness of 0.5 mm, and has discharge holes distributed radially from the center to the edge thereof as shown in the image of the following Table 1, wherein the discharge holes are present in a number of 20 discharge holes/1 $cm^2$ of unit area and have a size of 0.7 mm.

A pact using the rubber discharge pad according to the present disclosure, a conventional cake type pack having similar usability, a pact including a screen net and an airless pact are compared with one another, and determined for pay-off dispersibility and residual amount after use. The results are shown in Table 1. The pay-off dispersibility is determined by measuring how uniformly the contents are dispersed on puff, when the puff used as a cosmetic applicator is in contact with the contents and the contents are taken with the puff. The residual amount after use is determined by measuring the amount of contents remaining in a container, after the contents are taken with puff used as a cosmetic applicator to the highest degree, and calculating the ratio of the residual amount to the originally packed amount of the contents.

Comparative Example 1 is a cake type sample having a hardness of 60 as determined by ASKER Hardness Type D, and Comparative Example 2 is a cake type sample having a hardness of 250 as determined with an adaptor diameter of 10 cm by using SunRheo meter CR-200D. Viscosity of each of Comparative Example 3 and Example 1 is determined by using Brookfield Viscometer Model DV-II+ with spindle No. 29.

TABLE 1

| | Comp. Ex. 1 | Comp. Ex. 2 | Comp. Ex. 3 | Ex. 1 |
|---|---|---|---|---|
| Material | Conventional pact Cake type | Pact including screen net | Airless pact | Pact including rubber discharge pad (H-NBR) |
| Contents | Hardness 60 Cake type | Hardness 250 Cake type | 25,000 cps | 38,000 cps |
| Image | FIG. 6 | FIG. 7 | FIG. 8 | FIG. 9 |
| Characteristics | Conventional portable type | Portable and controllable in discharge amount through screen net. Not used to the end due to large amount of residual contents. | Portable and packable with liquid cosmetic agent. Contents are discharged from one ejection port in the form of agglomerate. | Portable and packable with liquid cosmetic agent. Used even to the contents present at the bottom by virtue of tension of rubber pad. |
| Applicator | Puff | Puff | Puff | Puff |
| Packing amount | 13 g | 13 g | 11 g | 13 g |
| Pay-off Dispersibility | 70% | 20% | 10% | 80% |
| Residual amount after use | 30% | 60% | 30% | 20% |

As can be seen from Table 1, the rubber discharge pad provides the highest pay-off dispersibility of contents on puff used to take the contents. In addition, the rubber discharge pad shows a reduced residual amount after use as compared to Comparative Examples 1, 2 and 3.

When the contents are taken with puff, Comparative Examples 1, 2 and 3 discharge the contents in the form of agglomerate, resulting in low pay-off dispersibility. In addition, upon the skin application, the contents are applied to the skin in the form of agglomerate, and thus an additional time is required to spread the contents uniformly on the skin. On the contrary, in the case of the pact including the rubber discharge pad (H-NBR) according to the present disclosure, it shows high pay-off dispersibility and allows uniform application on the skin without agglomeration. With reference to a residual amount after use, each of the conventional pact type, pact including a screen net and airless pact shows a residual amount of 30% or 60%. Thus, the conventional pact type and the pact including a screen net leave contents at the edge part of each container and the contents left at the edge part cannot be used with ease. In the case of the airless pact, it leaves a certain amount of residual contents in the pact structure due to its characteristic structure. On the contrary, the pact including the rubber discharge pad (H-NBR) according to the present disclosure facilitates use of residual contents present at the edge part of the container by virtue of the tension of rubber, resulting in a low residual amount.

Example 2

Different materials are used to provide rubber discharge pads in order to examine the restoring force and swelling strain for each of the materials (Examples 1-14): silicone rubber, fluorinated NBR, NBR-silicone composite rubber, H-NBR, wet polyurethane rubber, dry polyurethane rubber, polysulfide rubber, styrene-butadiene rubber (SBR), chloroprene rubber (CR), butadiene rubber (BR), isoprene-isobutylene rubber (IIR), ethylene propylene rubber (EPR), chlorosulfonated polyethylene rubber (HYPALON rubber (CSM)) and acryl rubber (AR). The restoring force is determined by mounting a rubber discharge pad to a container, pressing the center of the sheet with a circular applicator (application instrument) having a diameter of 4 cm to a depth of 1 cm for 10 seconds, and measuring the time required for the pad to restore its original shape. In addition, the swelling strain means strain caused by swelling of a rubber pad with a cosmetic agent, and is determined by dipping each rubber pad into 20 g of a cosmetic agent, allowing the rubber pad to stand at 55° C. for a predetermine time and measuring a change in weight. The results are shown in the followings Tables 2 and 3.

TABLE 2

| | Ex. 1 | Ex. 2 | Ex. 3 | Ex. 4 | Ex. 5 | Ex. 6 |
|---|---|---|---|---|---|---|
| Material | Wet polyurethane rubber | Dry polyurethane rubber | Silicone rubber | Fluorinated NBR | NBR-silicone composite rubber | H-NBR |
| Hardness (Shore) | 60A | 70A | 60A | 60A | 50A | 60A |
| Tensile strength ($kg/cm^2$) | 50 | 50 | 50 | 50 | 50 | 50 |
| Elongation (%) | 270% | 500% | 200% | 200% | 200% | 200% |
| Restoring force (sec) | 20 | 20 | 1 | 1 | 1 | 1 |
| Swelling strain (%) | 103 | 105 | 9 | 5 | 7 | 6 |

TABLE 3

| | Ex. 7 | Ex. 8 | Ex. 9 | Ex. 10 | Ex. 11 | Ex. 12 | Ex. 13 | Ex. 14 |
|---|---|---|---|---|---|---|---|---|
| Material | Polysulfide rubber | Styrene-butadiene rubber (SBR) | Chloroprene rubber (CR) | Butadiene rubber (BR) | isoprene-isobutylene rubber (IIR) | Ethylene-propylene rubber (EPR) | Chlorosulfonated polyethylene rubber (CSM) | Acryl Rubber (AR) |
| Hardness (Shore) | 60A | 60A | 60A | 60A | 70A | 70A | 70A | 70A |
| Tensile strength ($kg/cm^2$) | 30 | 50 | 50 | 60 | 60 | 70 | 70 | 70 |
| Elongation (%) | 200 | 270 | 240 | 270 | 270 | 370 | 270 | 270 |
| Restoring force (sec) | 600 | 3 | 5 | 7 | 20 | 1 | 30 | 10 |
| Swelling strain (%) | 130 | 110 | 130 | 120 | 120 | 110 | 120 | 130 |

Among the rubber discharge pad materials, silicone rubber, fluorinated NBR, NBR-silicone composite rubber and H-NBR show high restoring force, and allow use of the contents in the container to the highest degree, thereby reducing a residual amount. In addition, silicone rubber, fluorinated NBR, NBR-silicone composite rubber and H-NBR show a good swelling strain. As a result, it can be seen that use of silicone rubber, fluorinated NBR, NBR-silicone composite rubber or H-NBR is more suitable for controlling a discharge amount and reducing a residual amount.

The invention claimed is:

1. A cosmetic product, which comprises a rubber discharge pad made of a rubber material having discharge holes, and discharges contents through the discharge holes, wherein the cosmetic product further comprises a container for receiving a cosmetic composition and an applicator, and wherein the discharge holes have a size of 0.005-2.5 mm; and wherein the rubber material is at least one selected from the group consisting of acrylonitrile-butadiene rubber (NBR), fluorinated NBR, hydrogenated NBR, silicone rubber, and NBR-silicone composite rubber, wherein the contents are taken with the applicator, wherein the contents has a viscosity of 3,000-100,000 cps, wherein the rubber discharge pad has an elongation of 200%-500%, when force is applied to a unit area of 1 $cm^2$ of the rubber discharge pad in the longitudinal direction, and wherein the rubber discharge pad seals the container against to the exterior except the discharge holes.

2. The cosmetic product according to claim 1, wherein the discharge holes are present in a number of 1-50 per unit area of 1 cm2.

3. The cosmetic product according to claim 1, wherein the discharge holes are laser-perforated holes.

4. The cosmetic product according to claim 1, wherein the rubber discharge pad has a circular or polygonal shape.

5. The cosmetic product according to claim 1, wherein the rubber discharge pad has a Shore A hardness of 10A or more and a Shore D hardness of 75D or less.

6. The cosmetic product according to claim 1, wherein the rubber discharge pad has a thickness of 0.05-2 mm.

7. The cosmetic product according to claim 1, wherein the rubber discharge pad has a tensile strength of 20 kg/cm2 or more.

8. The cosmetic product according to claim 1, wherein the rubber discharge pad further comprises a rim surrounding the same.

9. The cosmetic product according to claim 1, which further comprises liquid, cream-like, semi-solid, solid or powdery contents.

10. The cosmetic product according to claim 1, wherein the contents comprise at least one selected from the group consisting of skin lotion, skin softener, skin toner, astringent, milk lotion, moisture lotion, nourishing lotion, massage cream, nourishing cream, essence, moisture cream, pigment-containing foundation, makeup base, eye makeup and blusher.

11. The cosmetic product according to claim 1, which is provided in the form of a pact, jar, airless, blow, tube or bottle.

* * * * *